US006471315B1

(12) United States Patent
Kurata

(10) Patent No.: US 6,471,315 B1
(45) **Date of Patent: *Oct. 29, 2002**

(54) RECORDING APPARATUS AND A RECORDING METHOD

(75) Inventor: Tetsuji Kurata, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/217,985

(22) Filed: Dec. 22, 1998

(30) Foreign Application Priority Data

Dec. 26, 1997 (JP) ..... 9-361503
Dec. 15, 1998 (JP) ..... 10-356583

(51) Int. Cl.[7] ..... B41J 25/308; B41J 29/38
(52) U.S. Cl. ..... 347/8; 347/16
(58) Field of Search ..... 347/8, 16, 14, 347/12, 43, 41, 40, 9; 346/140 R; 400/55, 56, 57, 58, 59

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 5,250,956 A | * | 10/1991 | Haselby et al. | 347/19 |
| 5,448,269 A | * | 9/1995 | Beauchamp et al. | 347/19 |

FOREIGN PATENT DOCUMENTS

| | | | | |
|---|---|---|---|---|
| EP | 0 372 826 | | 6/1990 | |
| JP | 54-056847 | | 5/1979 | |
| JP | 59-123670 | | 7/1984 | |
| JP | 59-138461 | | 8/1984 | |
| JP | 60-071260 | | 4/1985 | |
| JP | 08 080 655 | * | 12/1994 | 347/8 |
| JP | 09 156 087 | * | 6/1995 | 347/16 |
| JP | 8-80655 | | 3/1996 | |
| JP | 9-156087 | | 6/1997 | |

* cited by examiner

*Primary Examiner*—John S. Hilten
*Assistant Examiner*—Charles W. Stewart, Jr.
(74) *Attorney, Agent, or Firm*—Fitzpatrick, Cella, Harper & Scinto

(57) ABSTRACT

The recording apparatus and the recording method of the invention are provided with a recording head for ejecting ink onto a recording medium, a scanning section for moving the recording head in a predetermined direction to scan the recording medium and a correction section for controlling an ejection timing of the ink according to a discrepancy information on the recording medium to correct landing positions of the ink droplet on the recording medium. The discrepancy information on the recording medium represents a deviation of a paper-nozzle distance from a reference value. The paper-nozzle distance represents a distance from a nozzle portion of the recording head to the opposing recording medium. The recording apparatus and the recording method of the invention can correct the droplet landing position on the surface of the paper in the scan direction and produce an image with little dot position deviation.

33 Claims, 15 Drawing Sheets

RECORDING APPARATUS AND A RECORDING METHOD

This application is based on Japanese Patent Application No. 9-361503 (1997) filed Dec. 26, 1997 and Japanese Patent Application No. 10-356583 (1998) filed Dec. 15, 1998, the contents of which are incorporated hereinto by reference.

BACKGROUND OF THE INVENTION

FIELD OF THE INVENTION

The present invention relates to a recording apparatus and a recording method and more particularly to a recording apparatus and a recording method that performs recording on a recording medium by scanning the recording medium while ejecting ink from a recording head.

A recording apparatus connected to a computer can record or print an image on paper according to image data generated by the computer. Various types of printers have been devised including a dot impact type, a heat transfer type and an electrophotographic type. In recent years, an inkjet type has prevailed. The inkjet printer achieves printing by ejecting ink from the recording head and therefore can print on recording mediums with unsatisfactory surfaces including, for example, rough plain paper, leather and cloth as long as they can absorb ink.

A serial printer in particular, which comprises, in its basic configuration, a paper feeding mechanism, a head scan mechanism, a motor drive circuit, a head drive circuit, a data processing/control circuit, an operation/display circuit and a power supply circuit, has a simple construction as compared with a printer of the electrophotographic type such as a laser beam printer (LBP) that is in wide use at offices. Currently, the serial inkjet printer is widely used in small offices and homes as a popular, low-cost printer.

Here, a conventional commonly used inkjet printer is explained. Data entered from a computer into an input terminal is stored in a buffer of a signal processing circuit and converted into data corresponding to individual nozzles of the recording head. The converted data is transferred via a flexible cable to a head drive circuit on a carriage where it is converted into a signal for driving a heater of the recording head. The head drive circuit generates pulses in synchronism with the moving position of the carriage to eject ink. The position of the carriage can be obtained from a signal that is produced by reading the output of a linear encoder extending along the scan direction of the carriage or from a drive pulse for a carriage driving pulse motor.

When the printer receives data from the computer, a sheet of paper set in a paper supply unit is conveyed to the paper feeding mechanism. The recording head mounted on the carriage performs recording on the paper in a range corresponding to the head recording width. After recording is finished for one scan, the paper feeding mechanism feeds forward the paper by a distance equal to the recording width. The scanning and paper feeding are repeated as far as the paper can be fed, after which the paper is discharged from a discharge port.

Although the serial inkjet printer is relatively simple in construction, because the recording head scans and performs recording for each line, any misregistration or misalignment between the lines will clearly show in the printed image. Because the inkjet printer in particular ejects ink droplets onto the paper, the paper swells with ink and expands in a planar direction, causing dots near the joint between printed lines to be shifted out of alignment to a greater extent.

The increased misalignment between the lines results from the fact that the recording is performed by ink droplets landing on the paper, ejected from the nozzles of the recording head. The ink droplets that have landed on the surface of the paper penetrate into the interior of the paper where they are fixed. During this process, the water contained in the ink is soaked in the paper thereby swelling the paper. The swelling is not significant with films and paper with special coating. Plain paper, such as copy paper, swells easily. Our experiments show that when struck with 19.3 $nl/mm^2$ of ink, copy paper of one kind produced an elongation of about 0.51%. Generally, paper, after being printed, is restrained in position in the planar direction by spurs 5 as shown in FIG. 1, so that the swelled paper 2 is deformed like a wave over a flat platen 3 between the spurs 5 which are arranged at equal intervals in the scan direction. According to our calculations, when an undulation (hereafter referred to as cockling) occurs at four equally spaced locations in the longitudinal direction of A4 size paper (210 mm), for example, the surface of the recording medium is cockled by about 1.2 mm in the vertical direction as a result of the 0.5%-elongation in the planar direction. The effect of the cockling thus produced in one line shows when the next line is printed.

The ejection timing of ink droplets has conventionally been controlled on the assumption that the distance between the nozzles of the recording head and the paper (hereafter referred to as a paper-nozzle distance) is always constant and that the landing points on the surface of the recording medium are always determined by only the position of the nozzles. In reality, however, the ink landing point on the surface of the paper 2 does not coincide, for the reasons mentioned above, with the carriage position when the ink droplet is ejected, as shown in FIG. 2.

In FIG. 2, X represents the direction of scan and the broken line arrow represents the locus of an ink droplet when recording is performed at the conventional ink ejection timing. If the paper 2 on the platen 3 is not swelled, as shown by the broken line, the paper-nozzle distance remains unchanged and the ink droplet adheres on the position a. When, however, the paper 2 is swelled, it is deformed as shown by the solid line toward the carriage 9, changing the paper-nozzle distance, with the result that the ink droplet adheres on the position b. When there are changes in the paper-nozzle distance as caused by the cockling of the paper 2, dot positions may deviate in the planar direction as mentioned above if the ink is ejected in synchronism only with the carriage position.

SUMMARY OF THE INVENTION

It is therefore an object of the invention to control the ink ejection timing based on an information on deviation of the recording medium from the reference value of the distance between the recording medium and the ink nozzle portion of the recording head, that ejects ink droplets onto the recording medium, to correct the ink landing positions on the recording medium and thereby produce a printed image with no dot position deviations.

To improve the above-mentioned object, a recording apparatus and a recording method of the invention are presented. The recording apparatus comprises a recording head for ejecting ink onto a recording medium, a scanning means for moving the recording head in a predetermined direction to scan the recording medium and a correction means for controlling an ejection timing of the ink according to discrepancy information on the recording medium. The discrepancy information on the recording medium represents a deviation of a paper-nozzle distance from a reference value, the paper-nozzle distance representing a distance from a nozzle portion of the recording head to the opposing recording medium.

The recording method ejects an ink on a recording medium, by using a recording head provided with an ejection portion for ejecting the ink, and scans the recording medium by the recording head to perform recording on the recording medium. Moreover, the recording method comprises a step of obtaining discrepancy information on a deviation of a distance from the ejection portion of the recording head to the opposing recording medium, in a scan region of the recording head, and a step of controlling an ink ejection timing of the recording head according to the discrepancy information.

The above and other objects, effects, features and advantages of the present invention will become more apparent from the following description of the embodiments thereof taken in conjunction with the accompanying drawings.

DETAILED DESCRIPTION OF THE INVENTION (First Embodiment)

Figure 1:
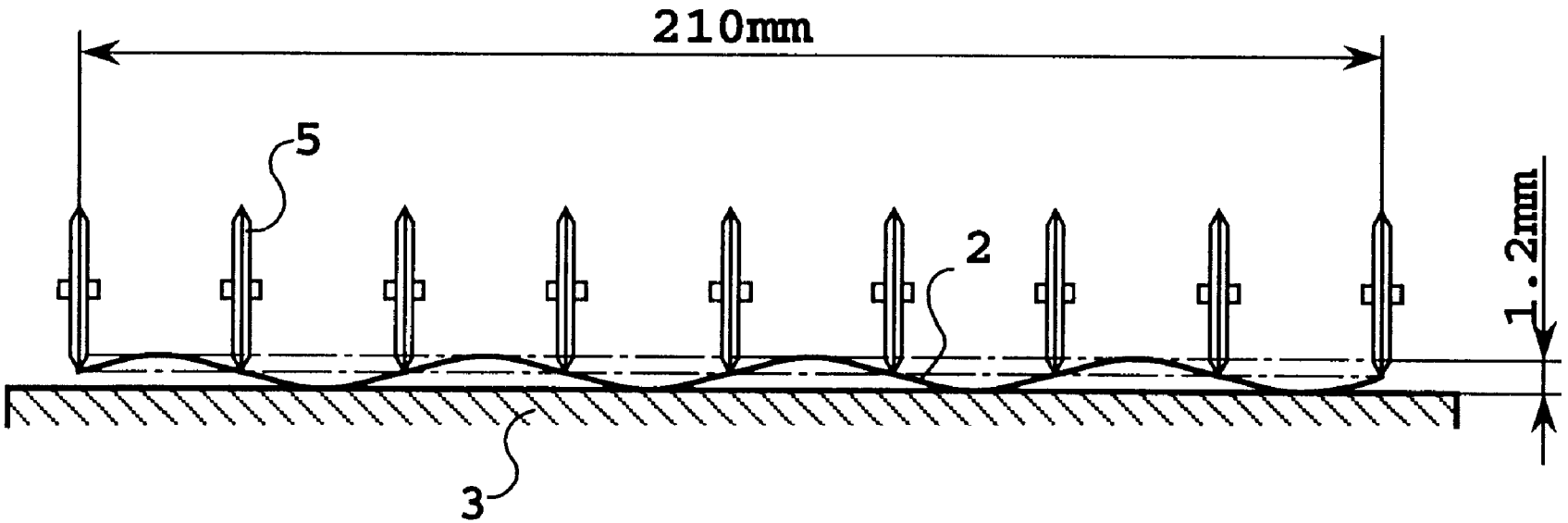
FIG. 1 is an explanatory view showing how cockling is formed.
Figure 2:
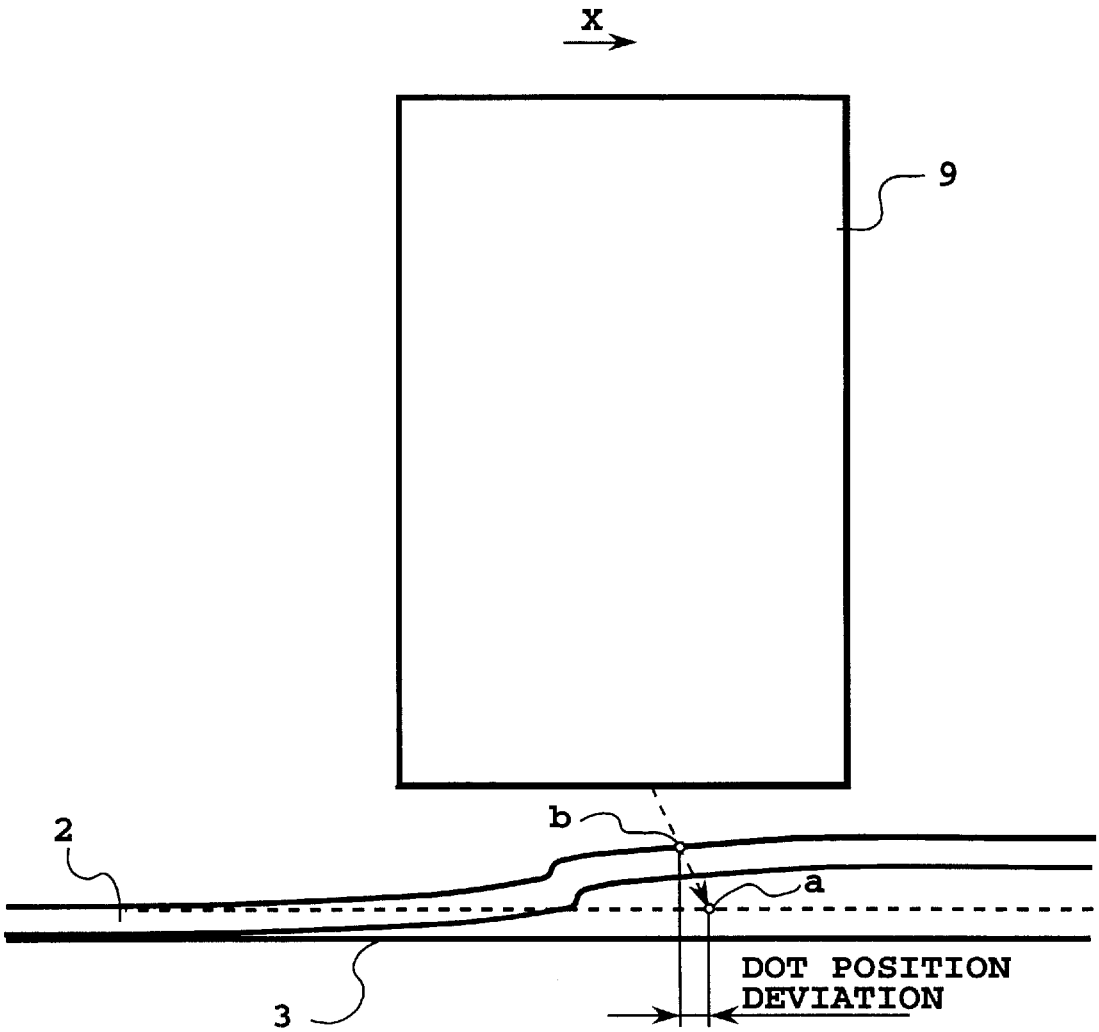
FIG. 2 is a schematic view showing a dot position deviation caused by the cockling.
Figure 3:
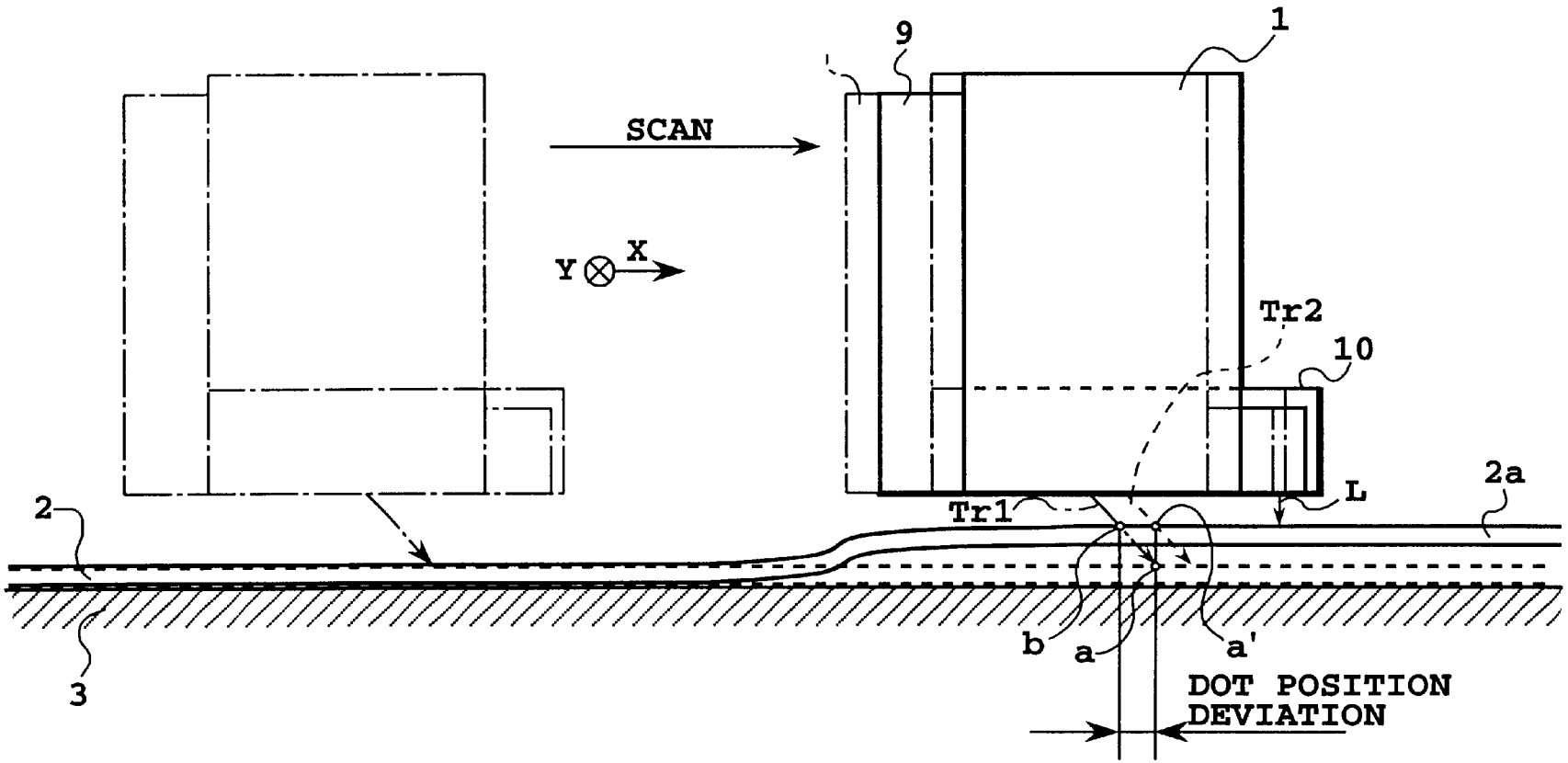
FIG. 3 is a schematic view showing an essential construction of a first embodiment of the invention.

A main construction of the first embodiment of the invention is shown in FIG. 3. The nozzles of a recording head 1 are arranged almost in the direction of paper feeding (Y direction) and eject ink droplets by producing bubbles in ink by a heater. Designated 2 is a sheet of paper, or a recording medium, which is generally a copying paper. A flat platen 3 provides a reference plane for maintaining the distance between the paper 2 and the recording head 1 at a fixed reference value. The reference value is a maximum distance between the nozzles of the recording head 1 and the opposing surface of the paper 2.

The paper 2 is fed in the direction Y of figure 3 by a feeding mechanism (not shown) to a position on the flat platen 3. A carriage 9 mounting the recording head 1 scans over the paper 2 (in the direction X) to perform recording on the paper 2.

The carriage 9 has a paper-nozzle distance sensor 10 mounted ahead of the nozzles in the scan direction, which outputs a signal corresponding to the paper-nozzle distance to a control unit described later as the carriage 9 performs scanning. The paper-nozzle distance sensor 10 directs a laser beam L against the paper 2, detects the reflected light and outputs a DC signal that changes its level according to the distance between the paper and the nozzles of the recording head.

The carriage 9 is driven by a drive motor (not shown) through a belt. The position of the carriage 9 in the direction X is obtained by a detection signal from an encoder, described later, which extends over the scan direction near the carriage 9.

Figure 4:
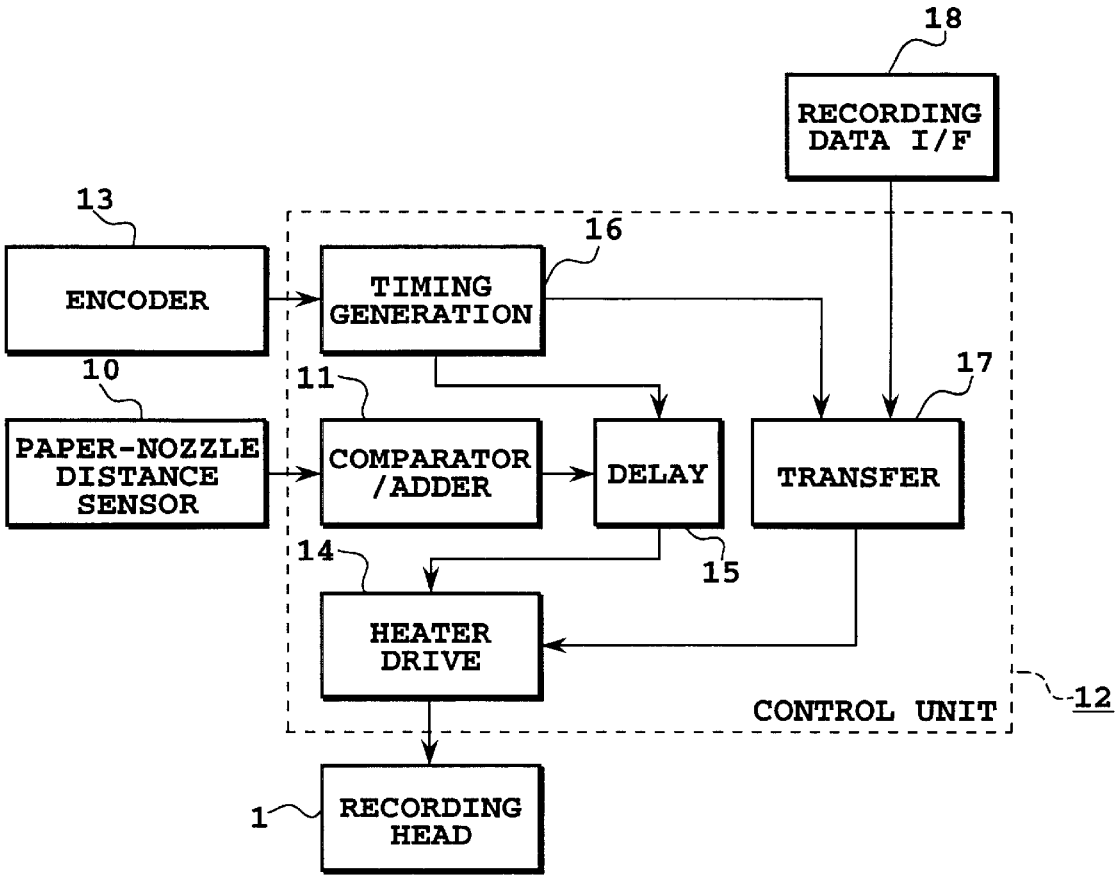
FIG. 4 is a block diagram showing a circuit configuration of the first embodiment.
Figure 5:
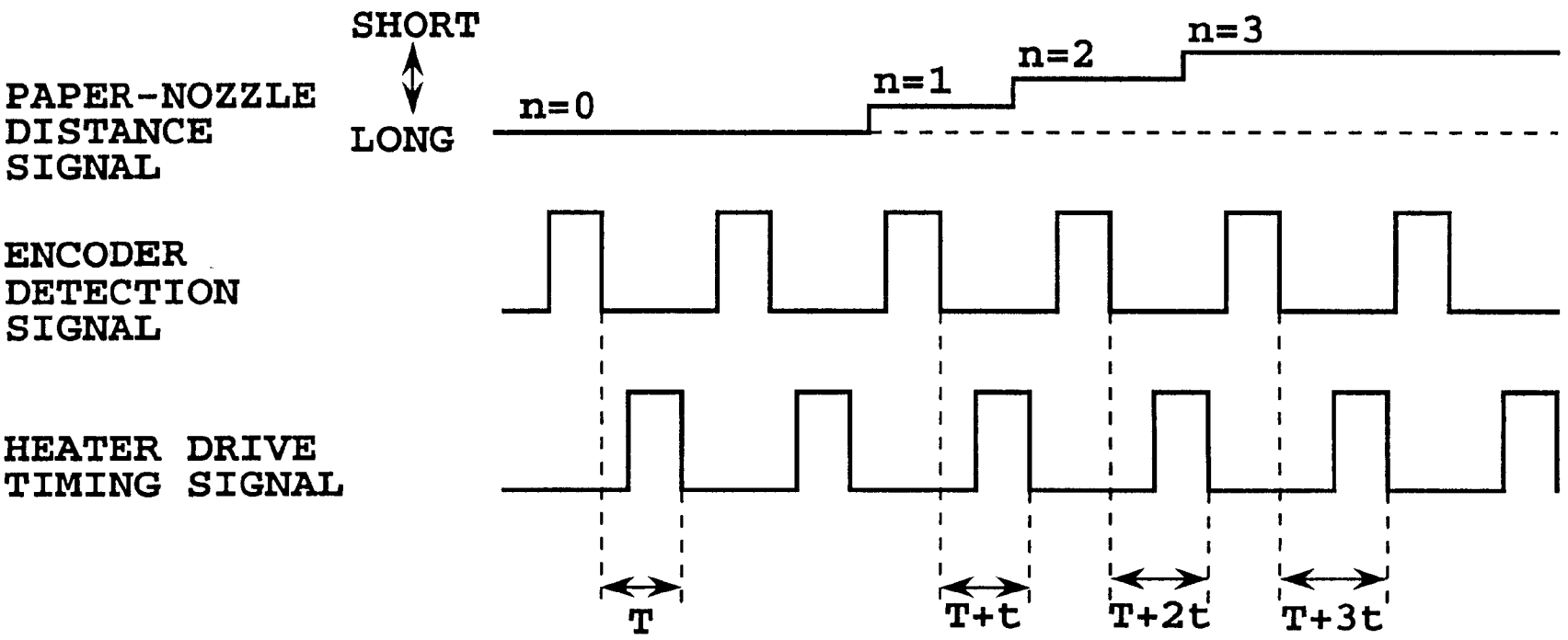
FIG. 5 is a timing diagram showing signals at various portions in FIG. 4.

FIG. 4 shows a block diagram of the first embodiment of the invention, and FIG. 5 shows a timing diagram of signals at various portions of FIG. 4.

Figure 6:
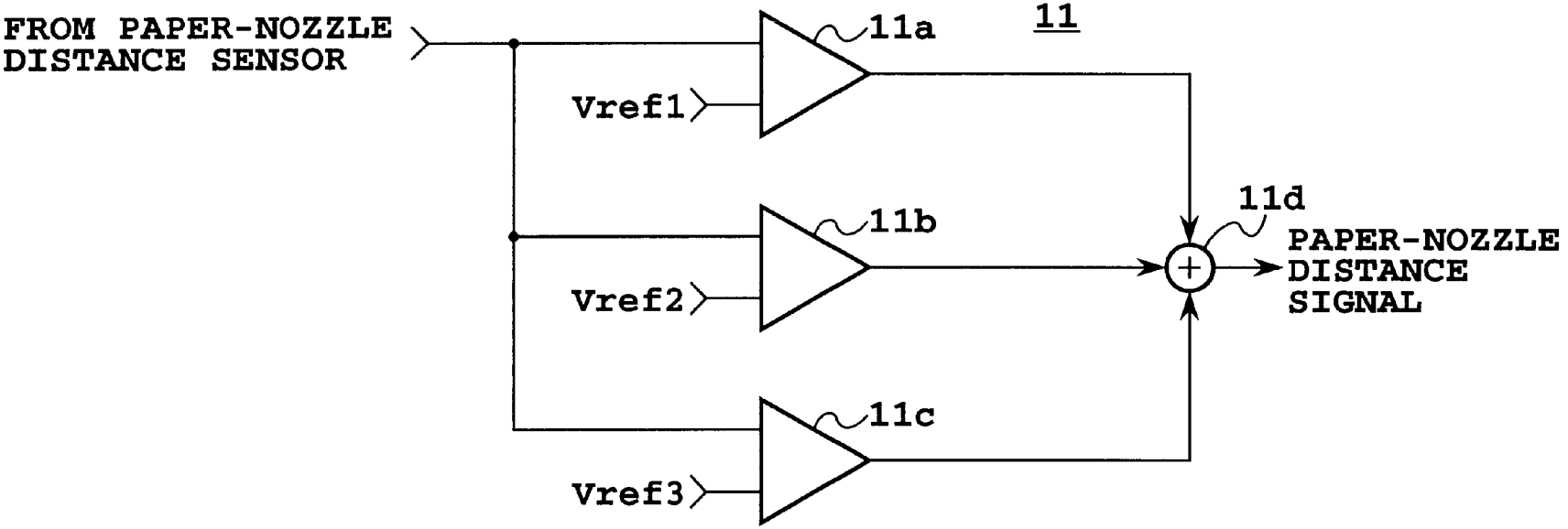
FIG. 6 is a block diagram of a comparator/adder circuit.

The DC detection signal (paper-nozzle distance signal) from the paper-nozzle distance sensor 10 and the detection signal from an encoder 13 (see FIG. 5) are sent to a control unit 12. A comparator/adder circuit 11 comprises three comparators 11*a*, 11*b*, 11*c* and an adder 11*d*, as shown in FIG. 6. Reference voltages Vref1, Vref2, Vref3, each having a different level, are supplied to these comparators, and compared with the DC detection signal from the paper-nozzle distance sensor 10 to produce a paper-nozzle distance signal (FIG. 5) in the comparator/adder circuit 11. The generated paper-nozzle distance signal is converted by an A/D converter (not shown) into digital data n, which becomes n=0 when the paper-nozzle distance is maximum (reference value) and progressively increases up to n=3 as the paper-nozzle distance decreases. The value of n varies according to discrepancy information, which represents the difference between the paper-nozzle distance detected and the reference value. A timing generation circuit 16 generates a latch signal upon receiving the detection signal from the encoder 13. A delay circuit 15 delays the latch signal by four different lengths of time T+nt (n=0, 1, 2, 3) according to the value of n to generate a heater drive timing signal (FIG. 5) as described below.

Figure 7:
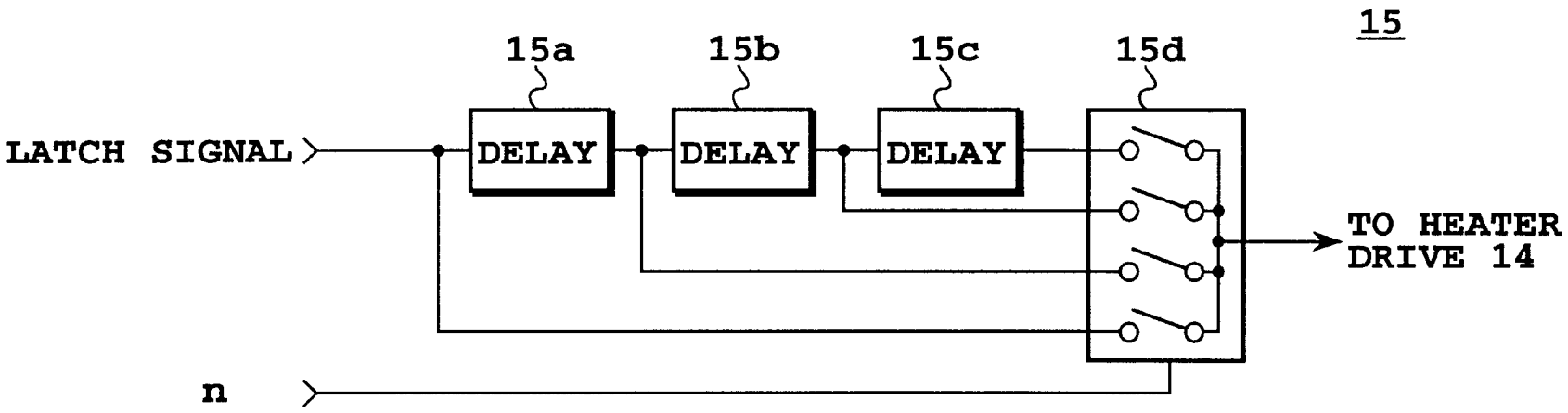
FIG. 7 is a block diagram of a delay circuit.

FIG. 7 shows one illustrative configuration of the delay circuit 15. Referring to FIG. 7, the delay circuit 15 is composed of three delay circuits or delay circuits 15*a*, 15*b*, and 15*c*, the each delay circuit delays its input signal by a predetermined delay time t before outputting it. The output of each delay circuit is supplied to an analog switch 15*d*, which selects one of the inputs according to the value of n to output to a heater drive circuit 14.

As described above, the heater drive timing signal is derived from the encoder detection signal, delaying by a length of time equal to the predetermined delay time T plus a variable delay time nt (n=0, 1, 2, 3) corresponding to the paper-nozzle distance signal. The heater drive circuit 14 drives the recording head 1 according to the recording data entered from a recording data interface 18 into a transfer circuit 17. The driving of the head is performed in synchronism with the heater drive timing signal.

Although detailed explanation is not given here, because the position of the paper-nozzle distance sensor 10 and the nozzle position of the recording head 1 are deviated in the X direction, the encoder detection signal is processed as described above with a delay of a predetermined number of pulses corresponding to the deviation amount.

Because the delay time for the ink droplet ejection timing is changed according to the deviation of the paper-nozzle distance from the reference value as described above, the deviation of the ink droplet from the intended landing position can be corrected. In other words, in FIG. 3, the ink droplet, which is ejected when the carriage 9 is at position 9*a* and is originally intended to follow a trace Tr1 to land at position a, would undesirably land at position b if the paper were cockled as shown at 2*a*. The ejection timing delay processing as described above, however, can correct the droplet flying route to a trace Tr2, causing the droplet to land on the cockled paper at position a'. Therefore, the droplet landing position on the surface of the paper 2 can be corrected in the scan direction at all times, producing an image with little dot position deviation.

While this embodiment concerns a serial inkjet printer as an example, the invention is also very effective in a full line type inkjet printer to correct the dot position deviation in the scan direction according to changes in the paper-nozzle distance. Other embodiments are also effective for both of the serial type and the full line type inkjet printers.

(Second Embodiment)

Figure 8:
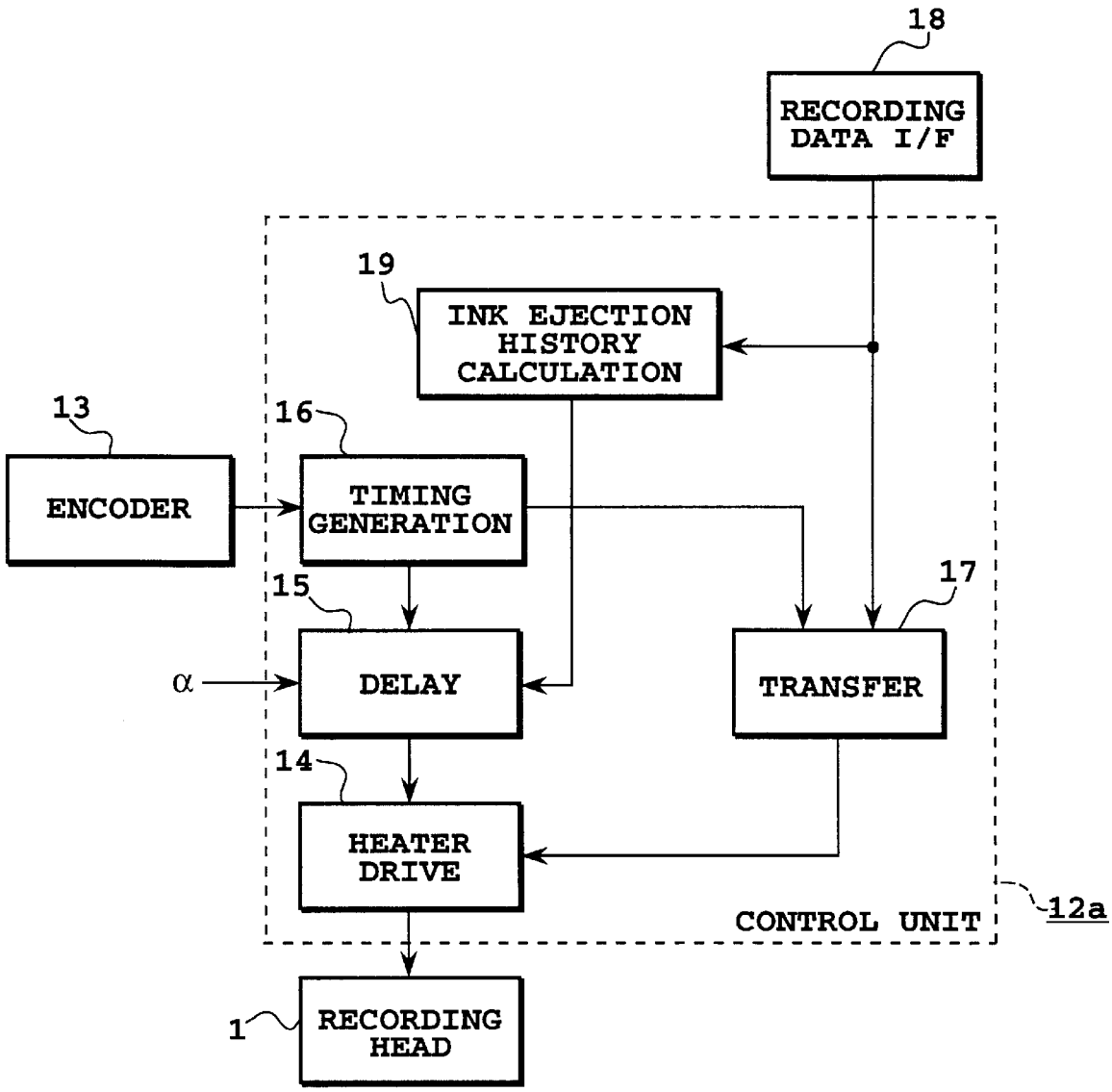
FIG. 8 is a block diagram showing a second embodiment of the invention.

FIG. 8 is a block diagram of a second embodiment of the invention. The block configuration of this embodiment is similar to that of the first embodiment, except that a control unit 12*a* does not have a paper-nozzle distance sensor and a comparator/adder circuit but instead includes an ink ejection history calculation section 19.

Figure 9:
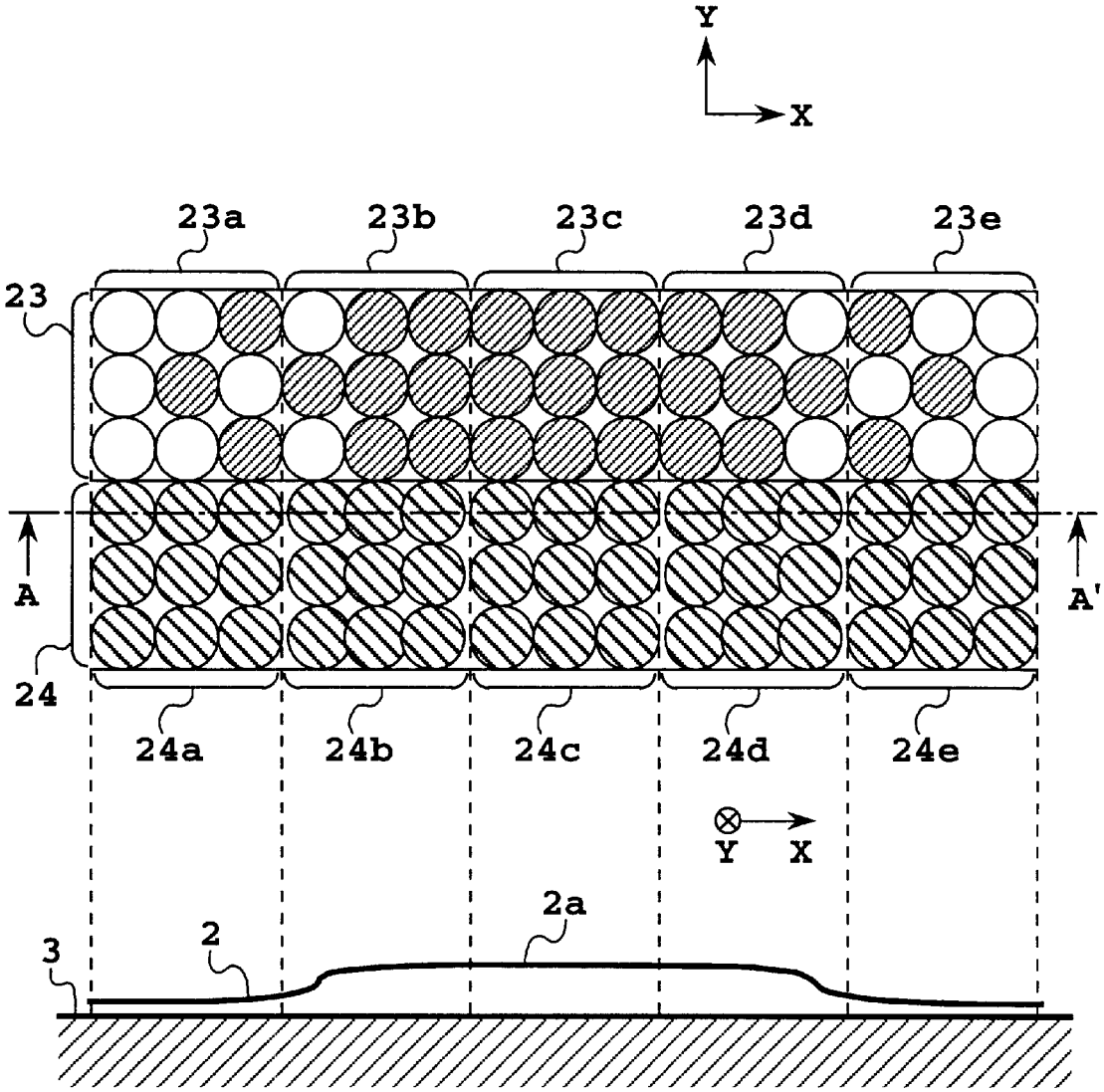
FIG. 9 is an explanatory view showing the second and third embodiments.

The ink ejection history calculation section 19 calculates an ink ejection history based on recording data supplied from the recording data interface 18. That is, the recording data for one scan is divided for a plurality of unit-area regions 23*a*, 23*b*, 23*c*, 23*d*, 23*e*, as shown in FIG. 9, and the ink ejection history calculation section 19 counts the number of ink droplets ejected onto each region and outputs the count value. The ink ejection history calculation section 19 can include a latch, a dot counter and an adder circuit. The delay circuit 15 delays the latch signal from the timing generation circuit 16 according to the count value, and outputs the delayed signal as a heater drive timing signal. The delayed timing signal corrects the ejection timing in the next scan line.

Figure 10:
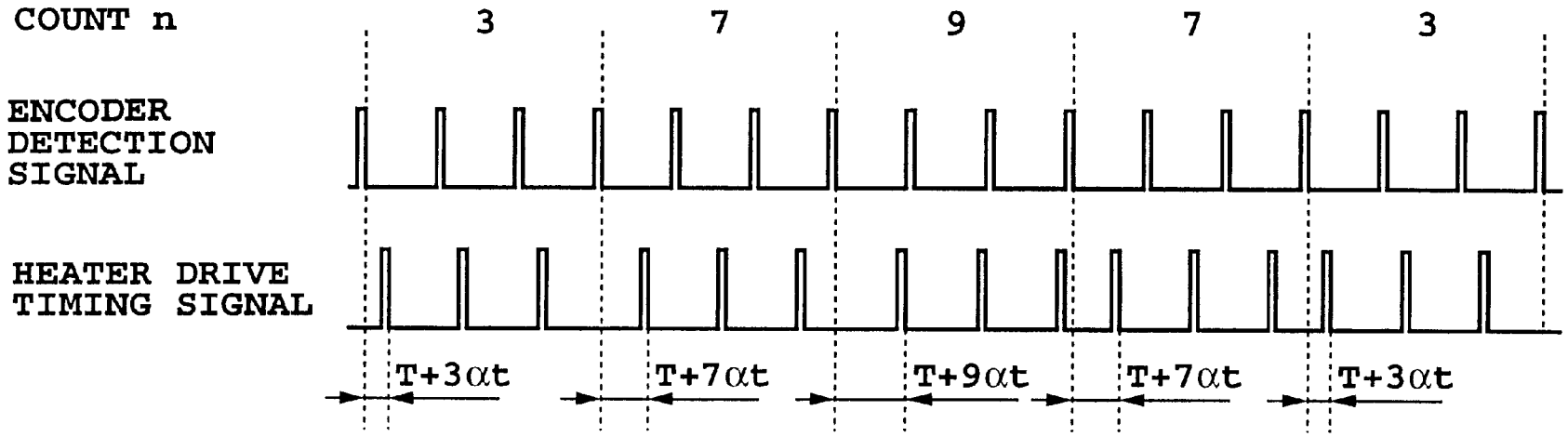
FIG. 10 is a timing diagram showing signals at various portions in FIG. 8.

FIG. 10 is a timing diagram showing signals at various parts of FIG. 8, which correspond to the recording data for the line 23 in FIG. 9. Although FIG. 9 shows each region as 3×3 dots for simplicity, another size can be used for the region. Black circles in the line 23 represent dot positions at which ink droplets were adhered and blank circles represent dot positions at which ink droplets were not adhered. Hatched circles in a line 24, which is to be scanned next, represent dot positions where ink droplets will adhere when ink droplets are ejected onto the surface of the paper 2 on the flat platen 3, that is swelled by the previously scanned line 23, as shown at 2*a*. This ink droplet ejection has its ejection timing corrected.

Thus, the count value n (FIG. 10) is 3 for the region 23*a*, 7 for the region 23*b*, 9 for the region 23*c*, 7 for the region 23*d*, and 3 for the region 23*e*. When the count value is small, the delay circuit 15 can be constructed of a plurality of delay circuits and an analog switch with inputs numbering one more than the delay circuits in the same way as the delay circuit 15 in FIG. 4. In the above configuration, the delay time of each delay circuit is set to $\alpha t$. The coefficient $\alpha$ is the one whose value varies dependent on the kind of paper. The value of $\alpha$ increases as the paper becomes more likely to be swelled. The coefficient $\alpha$ optimally corrects the ejection timing according to the kind of paper to offset differences among different kinds of paper in the amount of cockling caused by the same amount of ink. For example, the coefficient $\alpha$ is set to $\alpha=0$ for a film which is hardly swelled, and $\alpha=1$ for dedicated inkjet printing paper. For plain paper which is greatly affected by swelling, the $\alpha$ value is set larger than that of the dedicated inkjet printing paper. When the kind of paper is set by a printer driver installed in a host computer (not shown), preset values for the paper are used to calculate the coefficient $\alpha$, which is then given to the delay circuit 15.

In the above configuration, the scale of hardware increases as the count value increases. Thus, the configuration may be modified to allow the calculation processing to be performed in such a way that the delay time is $T+n\alpha t$ where n is the count value.

Next, the line 24 is scanned. In scanning a region 24*a* which is adjacent to the region 23*a* in the direction of paper feeding, an encoder detection signal (FIG. 10) is delayed by $T+3\alpha t$ according to the count value of 3 to produce the heater drive timing signal (FIG. 10). Similarly, for other regions 24*b*, 24*c*, 24*d* and 24*e* in the line 24, the encoder detection signal is delayed by $T+7\alpha t$, $T+9\alpha t$, $T+7\alpha t$ and $T+3\alpha t$, respectively, according to the count values, i.e., by the length of time corresponding to the number of ink droplets ejected one line before, to produce the heater drive timing signals, according to which the heater drive circuit 14 drives the recording head 1.

Thus, according to the amount of ink ejected (ejection event history) in each of the regions 23*a*, 23*b*, 23*c*, 23*d*, 23*e* of the previously scanned line 23, the ink droplet landing positions can be corrected for the regions 24*a*, 24*b*, 24*c*, 24*d*, 24*e* in the next adjacent line 24 as shown in FIG. 9, thereby producing an image without dot position deviations.

In FIG. 9, the dot positions in the regions 24*b*, 24*d* of the line 24 appear more uneven than those in other regions 24*a*, 24*c*, 24*e*. This is because the regions 24*b*, 24*d* are represented larger in area, for the sake of simplicity, than they actually are, although the paper 2 is inclined in these regions 24*b*, 24*d* (there are unequalities in the paper-nozzle distance), so that the amount of correction in the regions concerned appears constant (whereas the amount of correction actually depends on the paper-nozzle distance). By reducing the areas of the divided data regions, however, the uneven distribution of the dot positions, as seen in the inclined portions in FIG. 9, will pose no practical problem.

Figure 11:
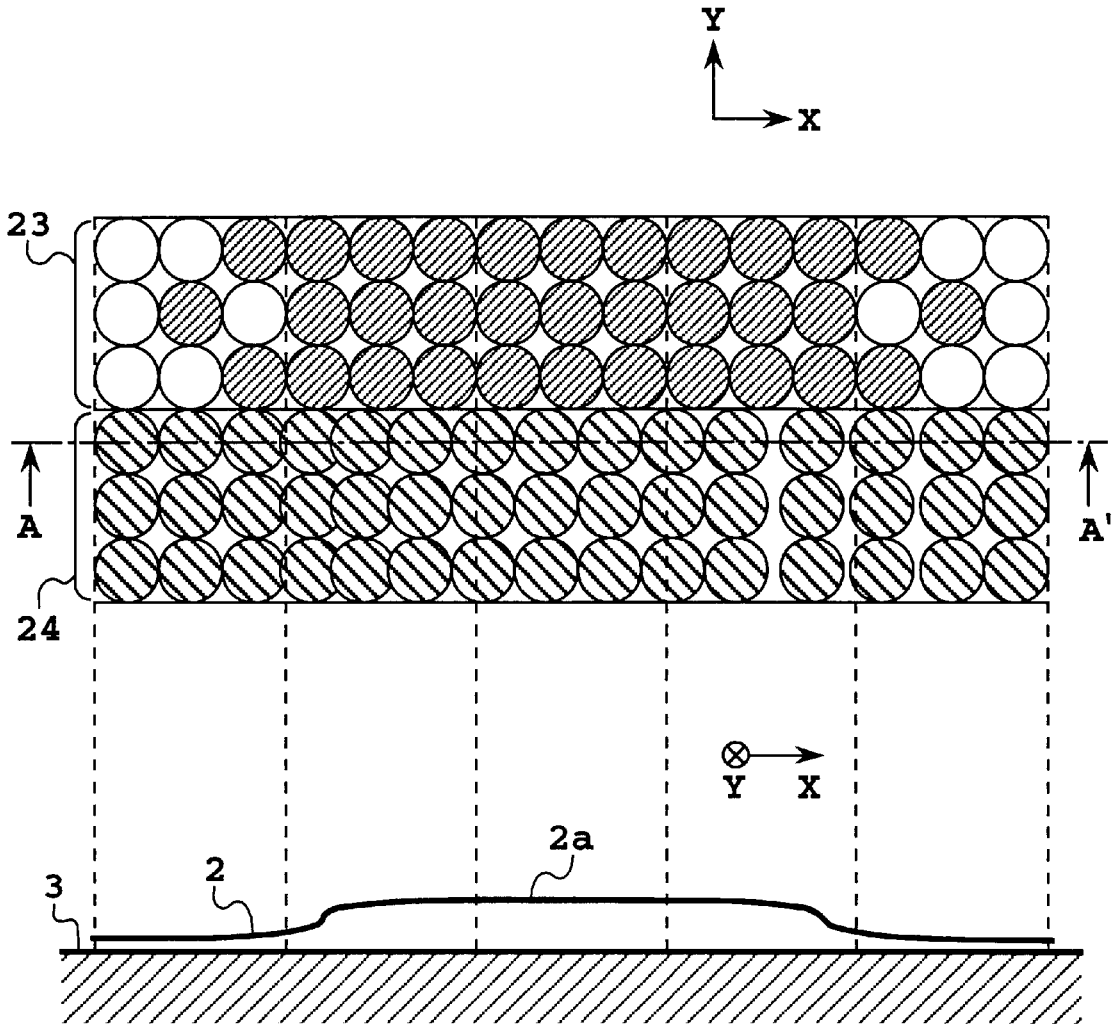
FIG. 11 is an explanatory view showing the second and third embodiments when correction is not made.

When the dot landing position correction by the ejection timing delay as explained above is not performed, the dot position misalignment will occur in the line 24 of FIG. 11 when compared with the ejection history of the previous scan (line 23) similar to the one shown in FIG. 9. The position deviation is particularly conspicuous as the paper is swelled at 2*a*. At the A-A' position of the line 24 next to the line 23, the dot position deviation is almost proportional to the amount of cockling of the paper 2.

In the second embodiment, as described above, the number of ink droplets ejected one line before (ejection event history) is used as the discrepancy information, representing the deviation of the paper-nozzle distance from the reference value. Based on the number of ink droplets ejected, the amount of cockling at the A-A' position in the next line 24 in FIG. 9 is estimated to perform the delay control on the ink ejection timing. It is therefore possible to correct the ink landing positions on the paper surface and eliminate the position misalignment as shown in FIG. 11, thereby producing an image without any dot position deviations.

(Third Embodiment)

Figure 12:
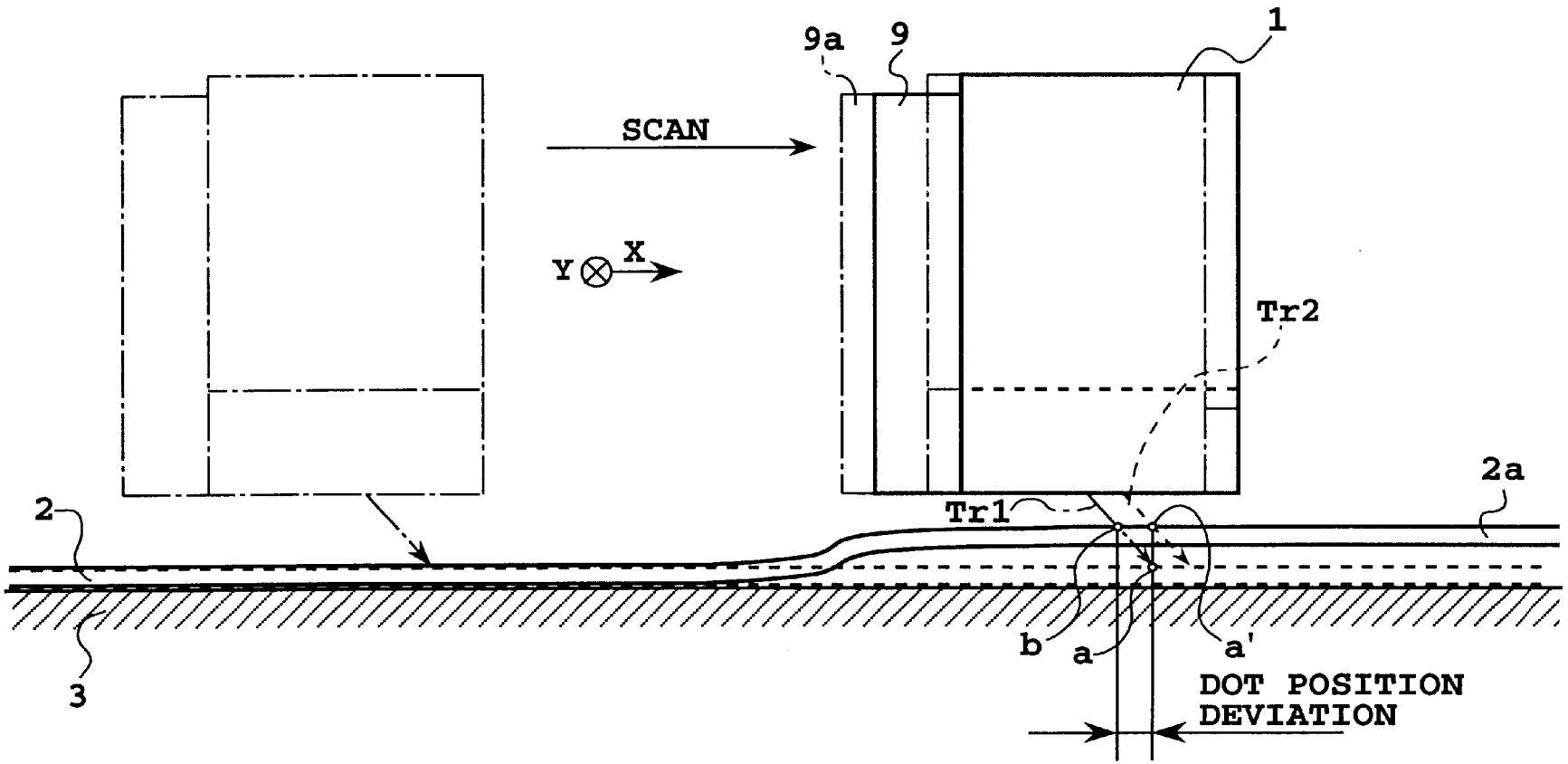
FIG. 12 is a schematic view showing an essential construction of a third embodiment of the invention.

The main construction of the third embodiment of the invention is shown in FIG. 12. The main construction of this embodiment is similar to that of the first embodiment, except that the carriage 9 is not provided with the paper-nozzle distance sensor 10. The third embodiment has the construction similar to that (not shown) of the second embodiment. In this embodiment, the ejection timing can be corrected irrespective of performance of the detection precision of the paper-nozzle distance sensor, and the carriage scanning speed can be increased faster.

Figure 13:
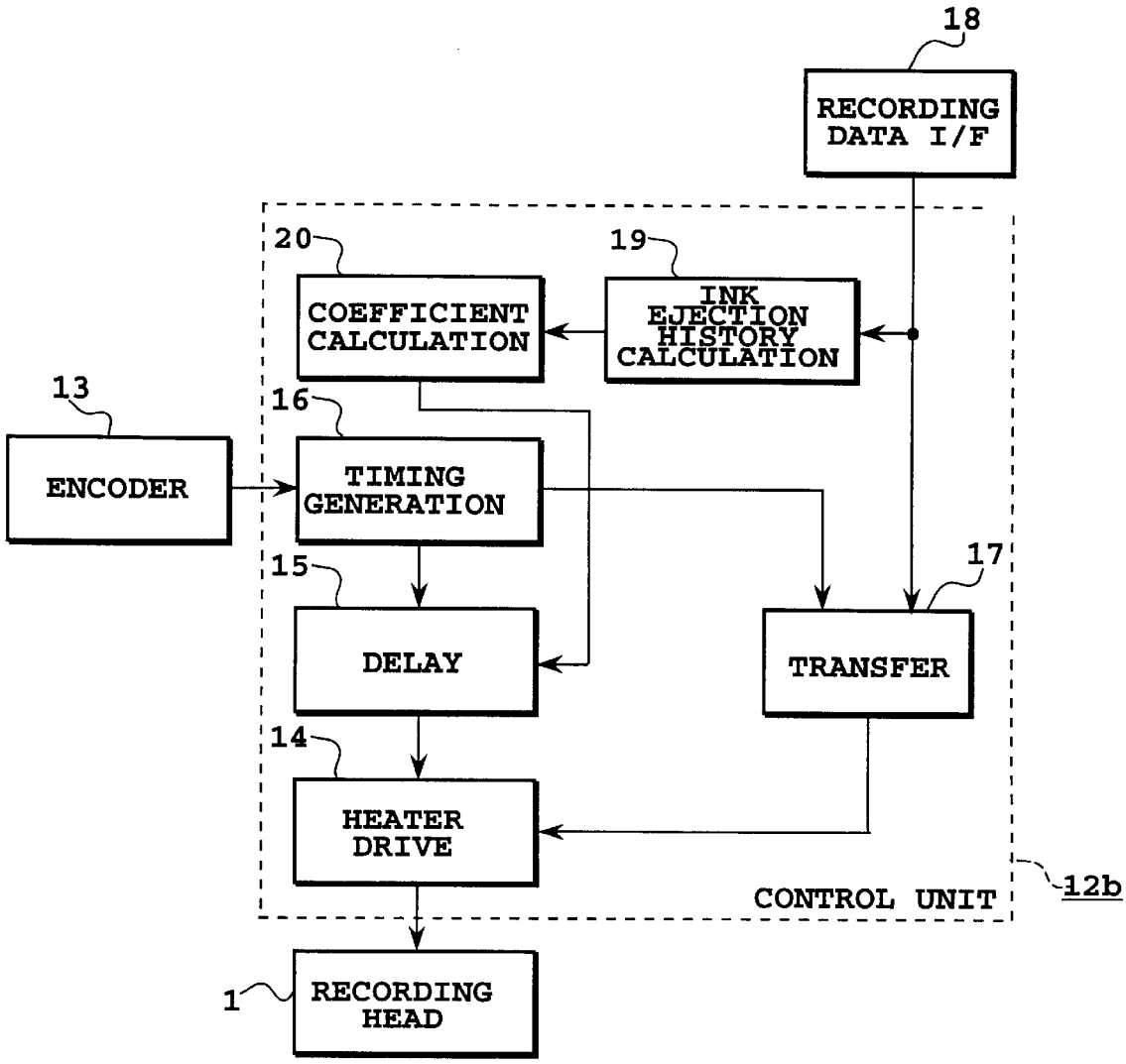
FIG. 13 is a block diagram showing a circuit configuration of the third embodiment.

FIG. 13 is a block diagram showing the third embodiment of the invention. The block configuration of this recording apparatus (printer) of the third embodiment is similar to that of the first embodiment, except that a control unit 12*b* is not provided with a comparator/adder circuit but instead includes the ink ejection history calculation section 19 and a coefficient calculation section 20. In other words, the third embodiment has the head configuration of the second embodiment without the paper-nozzle distance sensor, but with the coefficient calculation section 20 added. Signals at various parts of FIG. 13 that correspond to the recording data for the line 23 in FIG. 9 are similar to those shown in FIG. 10.

The detection signal (FIG. 10) from the encoder 13 is sent to the control unit 12*b*. The timing generation circuit 16 generates the latch signal according to the detection signal from the encoder 13. The delay circuit 15 for the delay time $\alpha t$ can be formed in the same manner as the delay circuit 15 in FIG. 7, and delays the generated latch signal by four different lengths of time T+nt (n=0, 1, 2, 3) according to the value of n, as described above, to produce the heater drive timing signal (FIG. 10).

The operations and configurations of the heater drive circuit 14, the transfer circuit 17, the recording data interface 18, the ink ejection history calculation section 19 and the recording head 1 are as explained above, and their descriptions are omitted here. The coefficient calculation section 20 computes the coefficient $\alpha$ that represents a parameter affecting the formation of cockling and gives the computed coefficient to the delay circuit 15. That is, the coefficient $\alpha$, which is supplied from outside the control unit in the second embodiment, is calculated inside the control unit 12*b* in this embodiment. The delay circuit 15 outputs the heater drive timing signal that is produced by delaying the latch signal from the timing generation circuit 16 according to the count value n and the coefficient $\alpha$. The delayed timing signal thus produced is used to correct the ink ejection timing during the next scan, in the same manner as the second embodiment. How the correction is carried out is shown in FIG. 9 as in the second embodiment, and its detailed explanation is omitted here.

With the above configuration, the hardware scale increases as the count value increases, as is the case with the second embodiment. To cope with this problem, the calculation processing may count a number proportional to the number of ink droplets so that the delay time will be $T+n\alpha t$ where n is the count value.

As described above, the third embodiment uses the number of ink droplets ejected one line before (ejection event history) as the discrepancy information, in a similar way to the second embodiment, representing the deviation of the paper-nozzle distance from the reference value and, based on the number of ejected ink droplets, estimates the amount of cockling in the A-A' position of the next line 24 in FIG. 9 to perform the delay control on the ejection timing. This delay control is so configured as to calculate and use the coefficient $\alpha$ that represents a parameter affecting the formation of cockling. It is therefore possible to correct the ink landing positions on the paper surface and eliminate the position misalignment as shown in FIG. 11 to produce an image without dot position deviations.

In a multi-pass recording, because the recording head scans over the same region of the paper two or more times, the recording is more susceptible to the cockling caused by the previous scan. The second and third embodiments can effectively be applied not only to a single-pass recording but to the multi-pass recording. In a recording apparatus in which the recording heads of different colors are arranged in the direction of paper feeding, these embodiments are particularly effective in aligning the dots of different colors in the direction of paper feeding.

(Fourth Embodiment)

The fourth embodiment can be applied to a recording apparatus in which a plurality of recording heads are arranged side by side at predetermined intervals in the direction of scan, and performs correction similar to that of the second embodiment on the individual recording heads in the scan direction.

Figure 14:
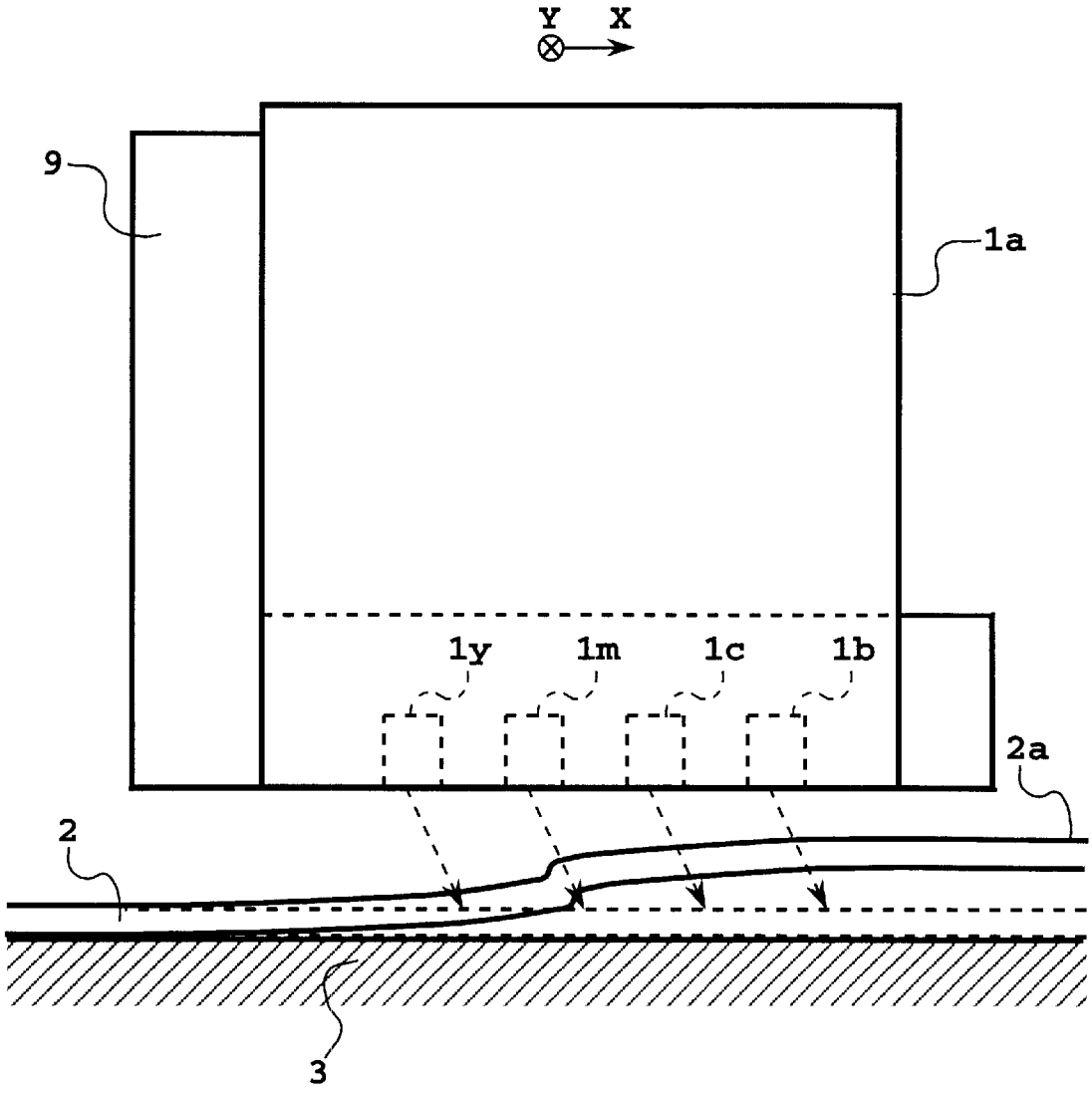
FIG. 14 is a schematic view showing an essential construction of a fourth embodiment of the invention.

FIG. 14 shows the main construction of the fourth embodiment. A recording head 1*a* mounted on the carriage 9 is for color printing. The recording head 1*a* has mounted therein at equal intervals, a recording head 1*b* for black ink, a recording head 1*c* for cyan ink, a recording head 1*m* for magenta ink and a recording head 1*y* for yellow ink, from the ahead toward the behind in the scan direction X. The nozzles of each recording head are arranged in the same direction as the paper feeding direction Y.

In the recording operation using the recording head 1*a* of the above construction, the recording head 1*b* first ejects black ink, after which the recording head 1*c* ejects cyan ink so that the cyan ink droplets land on the black ink dots. Then, at the same positions as the first black ink dots, ink droplets of different colors are landed successively (overlay ejecting) to form a color image. When the succeeding overlaying ink droplets land on the paper 2 on the flat platen 3, the paper 2 is swelled as shown at 2*a* dependent on the amount of inks already ejected from the recording heads located on the ahead or leading side in the scan direction X. Hence, to correct the landing positions, a control unit is formed in a similar configuration to the one shown in FIG. 8 and provided with an ink ejection history calculation section. The ink ejection history calculation section counts the number of ink droplets ejected onto the unit area of the paper 2 from other recording heads located ahead, in the scan direction, of each recording head. Further, according to the counting result, the ejection timing of each recording head is delayed to correct the landing positions.

For example, the ejection timing of the recording head 1*c* is delayed by a length of time corresponding to the total number of ink droplets ejected from the recording head 1*b* onto the unit area. The ejection timing of the recording head 1*m* is delayed by a length of time that corresponds to the sum of the number of ink droplets ejected from the recording head 1*b* onto the unit area and the number of ink droplets ejected from the recording head 1*c* onto the same unit area. In this way, the landing positions of ink droplets are corrected. These recording heads are not limited to the recording heads for different color inks, but may include those for processing liquids. Two or more recording heads of the same color may also be used.

In this way, this embodiment uses the number of ink droplets (ejection event history), as the discrepancy information that represents the deviation of the paper-nozzle distance from the reference value, which are ejected onto the unit area of the paper. Here, the above ejection onto the unit area is performed by the recording head located ahead of other recording heads in the scan direction, of the plurality of recording heads. Based on the number of ink droplets that have landed, the amount of cockling is estimated before the succeeding ink droplets are ejected overlying the preceding dots to perform the delay control on the ejection timing. Thus deviations of the landing positions on paper surface of dots ejected from each recording head can be corrected during one scan.

This correction performed during one scan may be combined with the correction that is performed between the lines in the second embodiment. Further, rather than counting the number of ink droplets, the second to fourth embodiments may be modified to compute the amount of ink ejected onto the unit area as the ink ejection event history.

When the kind of paper is set by the printer driver installed in the host computer (not shown), preset values for the paper are used to calculate the coefficient $\alpha$, which is then given to the delay circuit 15.

(Fifth Embodiment)

The coefficient $\alpha$ used in the second and third embodiments varies in value dependent only on the kind of the paper used. In the fifth embodiment, a coefficient $\alpha'$ is used, which includes another parameter in addition to the aforementioned coefficient $\alpha$. That is, the fifth embodiment can set, as a correction coefficient of a medium property, a coefficient $\alpha'$ which includes a coefficient ($\alpha 1$) dependent on the kind of ink in addition to the coefficient $\alpha$. For example, for an ink with a low penetration capability, $\alpha 1$ is set to $\alpha 1 \approx 1$ because the low penetration ink is unlikely to cause swelling; and for another ink with a high penetration capability, $\alpha 1$ is set to $\alpha 1 > 1$.

Further, as correction coefficients associated with the recording apparatus operation time, this embodiment can set another coefficient $\alpha'$ that includes a coefficient ($\alpha 2$) dependent on the head scanning speed (=carriage travel speed) in addition to the above coefficient $\alpha$, and also another coefficient $\alpha'$ that includes a coefficient ($\alpha 3$) dependent on the head scan time interval in addition to the coefficient $\alpha$. In a recording apparatus with a recording head, such as the one shown in FIG. 14, which comprises a plurality of recording heads arranged side by side at predetermined intervals in the scan direction, the coefficient setting that includes the coefficient ($\alpha 2$) dependent on head scan speed is effective because the swelling proceeds immediately after the ink droplets ejected from the adjoining head adhere to the paper. When the scanning is fast, the swelling initiated by the ink ejected from the adjacent head does not proceed greatly, and thus $\alpha 2$ is set to $\alpha 2 \approx 1$. When the scanning is slow, the swelling initiated by the ink ejected from the adjacent head proceeds significantly, and the coefficient $\alpha 2$ is set to $\alpha 2 > 1$. Further, before the current line is recorded, the swelling proceeds after the preceding line has been recorded regardless of the construction of the recording head, and thus the coefficient setting that includes the coefficient ($\alpha 3$) dependent on the head scan time interval as an additional factor is effective, whatever the head configuration may be. If the scan time interval is short, the swelling will not easily proceed and thus the coefficient $\alpha 3$ may be set to $\alpha 3 \approx 1$; and if the scan time interval is long, the swelling will easily proceed and $\alpha 3$ may be set to $\alpha 3 > 1$.

Furthermore, as correction coefficients associated with the operation environment of recording apparatus, this embodiment can set another coefficient $\alpha'$ that includes a coefficient ($\alpha 4$) dependent on the ambient temperature in addition to the above coefficient $\alpha$, and also another coefficient $\alpha'$ that includes a coefficient ($\alpha 5$) dependent on the ambient humidity in addition to the coefficient $\alpha$. Where the coefficient ($\alpha 4$) dependent on the ambient temperature is used, when the ambient temperature is high, the coefficient is set at $\alpha 4 \approx 1$ because at high temperature the paper itself is elongated and the soaked ink is easily dried. When the ambient temperature is low, the paper itself is shrunk and the ink is not easily dried, so that it is set to $\alpha 4 > 1$. When the coefficient ($\alpha 5$) that depends on the ambient humidity is used and when the ambient humidity is high, the paper itself is swelled and the degree of swelling caused by ink is small, so that the coefficient $\alpha 5$ may be set to $\alpha 5 \approx 1$. When the ambient humidity is low, the degree of swelling by ink is large, so that $\alpha 5$ is set to $\alpha 5 > 1$.

All the above values of coefficients are utilized to estimate the degree to which the paper is swelled. For parameters other than those exemplified above, it is also possible to use the parameters affecting the swelling of paper in the form of $\alpha x$, to set the $\alpha x$ value to $\alpha \approx 1$ for parameters that make the swelling unlikely and to $\alpha x > 1$ for parameters that facilitate the swelling, and to define the coefficient $\alpha'$ that combines a variety of parameters as follows:

$$\alpha' = \alpha 1 \times \alpha 2 \times \ldots \times \alpha n$$

Preset values for the parameters (kind of ink, head scanning speed, head scan time interval, ambient temperature, and ambient humidity) are used to calculate the coefficient $\alpha'$, which is then sent to the delay circuit 15. Thus these parameters can be reflected on the delay time.

With this embodiment, therefore, it is possible to estimate the degree to which the paper is cockled according to the kind of paper as well as other parameters and, based on the result of estimation, to correct the dot landing positions to produce an image without dot position deviations.

(Sixth Embodiment)

Figure 15:
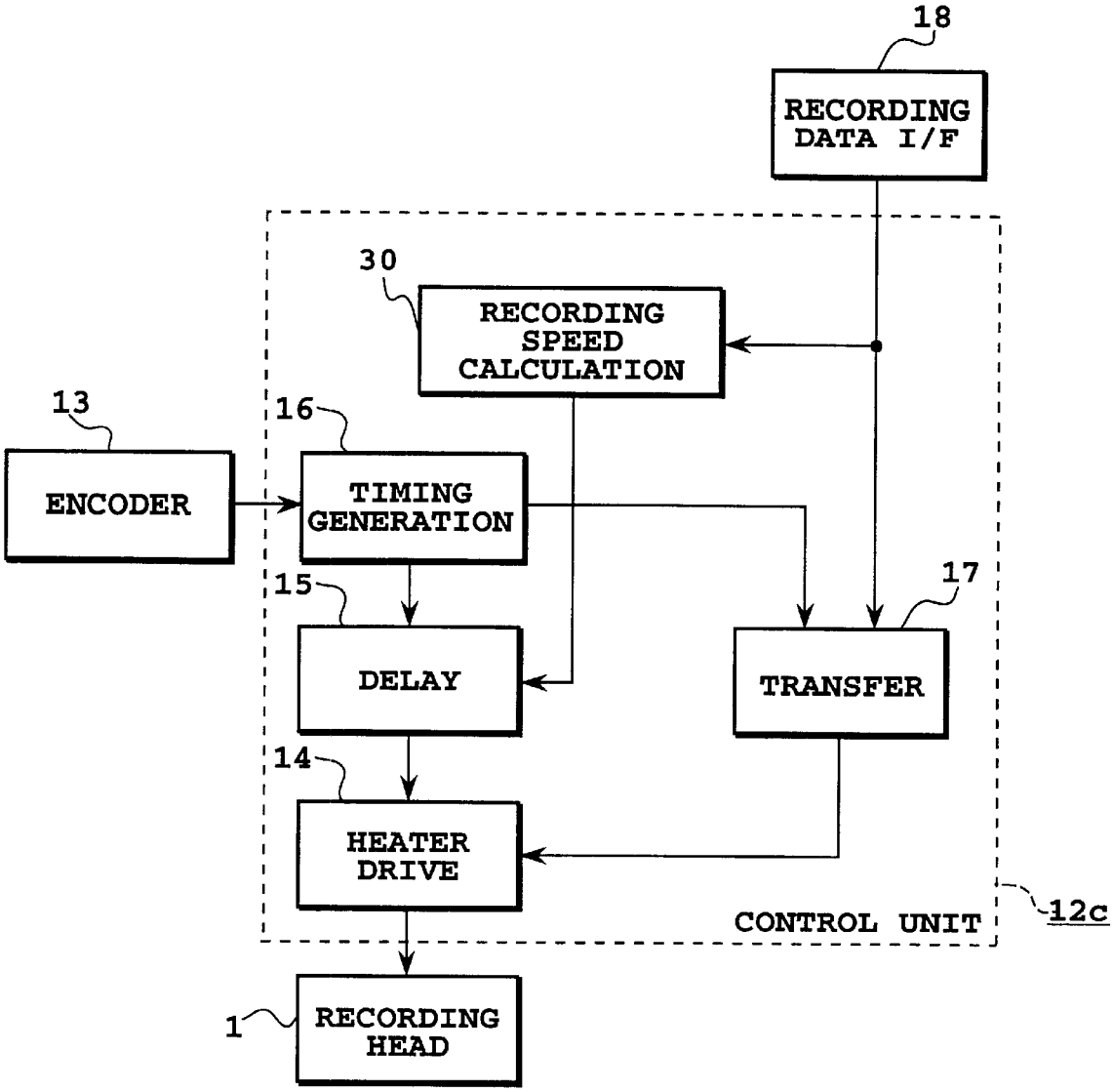
FIG. 15 is a block diagram showing a circuit configuration of the sixth embodiment.

FIG. 15 shows a block configuration of the sixth embodiment. The block configuration of the recording apparatus of this embodiment is almost similar to that of the second embodiment, except that a control unit 12*c* is not provided with the ink ejection history calculation section but includes a recording speed calculation section 30. In this embodiment, the head scan time interval is calculated based on the recording data and, according to this scan time interval obtained, the degree to which the cockling has progressed is estimated.

The recording speed calculation section 30 calculates the recording speed as described below by using the recording data supplied from the recording data interface 18. When the recording data is large in amount, the transfer circuit 17 takes time for processing the signals of the large-capacity recording data, so that the time interval between the previous scan and the next scan is long, lowering the recording speed. When the recording data is small in amount, it can be processed in a short period of time increasing the recording speed. Thus, the recording speed calculation section 30 calculates the amount of recording data for each scan and, based on the calculated data amount, determines the recording speed.

In other words, the recording speed calculation section 30, after calculating the recording data amount for each scan, then calculates the signal processing time. The signal processing time is the time which elapses from a moment when the recording data for the previous scan is processed by the transfer circuit 17 and supplied to the recording head 1 to a moment when the recording data for the next scan is supplied to the recording head 1. When the processing time is long (i.e., the scan time interval is long), the swelling of paper caused by ink progresses greatly and the ejection timing is corrected to extend the delay time. When the processing time is short (i.e., the scan time interval is short), the swelling by the ink ejected previously does not proceed greatly and the ejection timing is corrected to shorten the delay time. In this way, by using the scan time interval (ejection event history) as the discrepancy information which represents the deviation of the paper-nozzle distance (distance between the nozzle portion of the recording head and the opposing paper) from the reference value, it is possible to estimate, based on the scan time interval, i.e. the recording speed, the degree to which the cockling has progressed and to correct the dot landing positions to produce an image without dot position deviations.

While in the above embodiments the discrepancy information is generated in the recording apparatus, a variety of the discrepancy information used in the above embodiments may be generated from the recording data in the host computer, which is externally connected to the recording apparatus, and the generated discrepancy information may be supplied to the recording apparatus along with the recording data.

The present invention achieves distinct effects when applied to a recording head or a recording apparatus which has means for generating thermal energy such as electrothermal transducers or laser light, and which causes changes in ink by the thermal energy so as to eject ink. This is because such a system can achieve high density and high resolution recording.

A typical structure and operational principle thereof are disclosed in U.S. Pat. Nos. 4,723,129 and 4,740,796 and it is preferable to use these basic principles to implement such a system. Although this system can be applied either to on-demand type or continuous type inkjet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated into the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the inkjet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which whould otherwise cause the temperature rise; or the ink, which is dry when left in air, is liquefied in response to the thermal energy of the recording signal. In such cases, the ink may be retained in recesses or through-holes formed in a porous sheet as liquid or solid substances so that the ink faces the electrothermal transducers as described in Japanese Patent Application Laid-open Nos. 54-56847 (1979) or 60-71260 (1985). The present invention is most effective when it uses the film boiling phenomenon to expel the ink.

Furthermore, the inkjet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A recording apparatus comprising a scanning means for moving a recording head, which ejects ink onto a recording medium, over the recording medium in a predetermined direction, said recording apparatus comprising:

correction means for controlling an ejection timing of the ink according to discrepancy information regarding the recording medium, wherein the discrepancy information regarding the recording medium represents a deviation of a paper-nozzle distance from a reference value, the paper-nozzle distance representing a distance from an ink ejection portion of the recording head to the opposing recording medium.

2. A recording apparatus as claimed in claim 1, further comprising ejection history calculation means for calculating an ink ejection event history of the recording head, wherein the ink ejection event history thus calculated is used as the discrepancy information and said correction means changes the ejection timing of the ink by a length of time corresponding to the ink ejection event history.

3. A recording apparatus as claimed in claim 2, wherein said ejection history calculation means counts a number of ink droplets ejected onto a unit area of the recording medium during a previous scan by said scanning means and said correction means corrects an ejection timing during a next scan according to the count result.

4. A recording apparatus as claimed in claim 2, wherein said ejection history calculation means counts an amount of ink of the ink droplets ejected onto a unit area of the recording medium during a previous scan by said scanning means and said correction means corrects an ejection timing during a next scan according to the count result.

5. A recording apparatus as claimed in claim 2, wherein said recording head comprises a plurality of recording head units arranged at predetermined intervals in the predetermined direction, said ejection history calculation means counts a number of ink droplets ejected onto a unit area of the recording medium from a recording head unit located ahead of one of the plurality of recording head units in a scan direction, and said correction means corrects an ejection timing of the one of the recording head units according to the count result.

6. A recording apparatus as claimed in claim 5, wherein said correction means extends a delay time of the ejection timing when the number of ink droplets ejected onto the unit area is large.

7. A recording apparatus as claimed in claim 2, wherein the recording head comprises a plurality of recording head units arranged at predetermined intervals in the predetermined direction, said ejection history calculation means counts an ink amount of ink droplets ejected onto a unit area of the recording medium from a recording head unit located ahead of one of the plurality of recording head units in a scan direction, and said correction means corrects an ejection timing of the one of the recording head units according to the count result.

8. A recording apparatus as claimed in claim 7, wherein said correction means extends a delay time of the ejection timing when the amount of ink ejected onto the unit area is large.

9. A recording apparatus as claimed in claim 2, wherein a kind of the recording medium is further used as the discrepancy information.

10. A recording apparatus as claimed in claim 9, wherein said correction means extends a delay time of the ejection timing when the kind of the recording medium is one that facilitates swelling of the recording medium.

11. A recording apparatus as claimed in claim 2, wherein a kind of the ink is further used as the discrepancy information.

12. A recording apparatus as claimed in claim 11, wherein said correction means extends a delay time of the ejection timing when the kind of the ink is one that easily penetrates into the recording medium.

13. A recording apparatus as claimed in claim 2, wherein a scanning speed of the scanning means is further used as the discrepancy information.

14. A recording apparatus as claimed in claim 13, wherein said correction means extends a delay time of the ejection timing when the scanning speed of the scanning means is slow.

15. A recording apparatus as claimed in claim 2, wherein a scan time interval of the scanning means is further used as the discrepancy information.

16. A recording apparatus as claimed in claim 15, wherein said correction means extends a delay time of the ejection timing when the scan time interval of the scanning means is long.

17. A recording apparatus as claimed in claim 2, wherein an ambient temperature in said recording apparatus is further used as the discrepancy information.

18. A recording apparatus as claimed in claim 17, wherein said correction means extends a delay time of the ejection timing when the ambient temperature in said recording apparatus is low.

19. A recording apparatus as claimed in claim 2, wherein an ambient humidity in said recording apparatus is further used as the discrepancy information.

20. A recording apparatus as claimed in claim 19, wherein said correction means extends a delay time of the ejection timing when the ambient humidity in said recording apparatus is low.

21. A recording apparatus as claimed in claim 1, further comprising a speed calculation means for calculating a value based on a recording speed of the recording head, wherein the recording speed-based value thus calculated is used as said discrepancy information and said correction means changes the ejection timing of the ink by a length of time corresponding to the recording speed-based value.

22. A recording apparatus as claimed in claim 21, wherein said speed calculation means determines a processing time which elapses from a moment when recording signals for a previous scan by the scanning means are supplied to the recording head to another moment when recording signals for a next scan are supplied to the recording head.

23. A recording apparatus as claimed in claim 22, wherein said correction means extends a delay time of the ejection timing when the processing time is long.

24. A recording apparatus as claimed in claim 1, further comprising detection means for detecting the distance, wherein a difference between the reference value and the distance thus detected is used as the discrepancy information and said correction means changes the ejection timing of the ink by a length of time corresponding to the difference.

25. A recording apparatus as claimed in claim 24, wherein said correction means extends a delay time of the ejection timing when the difference between the reference value and the detected distance is long.

26. A recording apparatus as claimed in claim 24 or 25, wherein said detection means is mounted on the scanning means ahead of the ink ejection portion in the scan direction, and radiates light against the recording medium during a scan performed by the scanning means to detect the distance.

27. A recording apparatus as claimed in any one of claims 1 to 25, wherein the recording head comprises heating means for heating the ink to generate bubbles.

28. A recording method of ejecting an ink on a recording medium, by using a recording head provided with an ejection portion for ejecting the ink, and scanning the recording head over the recording medium to perform recording on the recording medium, said recording method comprising the steps of;

obtaining discrepancy information based on a deviation of a distance from the ejection portion of the recording head to the opposing recording medium, in a scan region of the recording head, and controlling an ink ejection timing of the recording head according to the discrepancy information.

29. A recording method as claimed in claim 28, further comprising the step of calculating an ink ejection event history, and wherein said obtaining step includes obtaining the discrepancy information according to the calculated ink ejection event history.

30. A recording apparatus for ejecting an ink on a recording medium, by using a recording head provided with an ejection portion for ejecting the ink, to perform recording on the recording medium, said recording apparatus comprising:

scan means for scanning the recording head over the recording medium in a predetermined direction;

obtaining means for obtaining discrepancy information based on a deviation of a distance from the ejection portion of the recording head to the opposing recording medium, in a scan region of the recording head; and control means for controlling an ink ejection timing of the recording head according to the discrepancy information.

31. A recording apparatus for ejecting an ink onto a recording medium, by using a recording head provided with an ejection portion for ejecting the ink, to perform recording on the recording medium, said recording apparatus comprising:

scan means for scanning the recording head in a predetermined direction;

control means for ejecting the ink from the recording head to perform recording as the recording head is scanned by said scan means; and correction means for controlling an ejection timing of the ink, wherein said correction means corrects the ejection timing such that the recording head ejects the ink in accordance with discrepancy information regarding a deviation of a paper-nozzle distance from a reference value, the paper-nozzle distance representing a distance from the ejection portion of the recording head to the recording medium.

32. A recording apparatus as claimed in claim 31, wherein the recording head comprises heating means for heating the ink to generate bubbles.

33. A recording method of ejecting an ink onto a recording medium, by using a recording head provided with an ejection portion for ejecting the ink, to perform recording on the recording medium, said recording method comprising the steps of:

a scan step of scanning the recording head in a predetermined direction; and a recording step of injecting the ink from the recording head to preform recording as the recording head is scanned, wherein an ejection timing is corrected in said recording step such that the recording head ejects the ink in accordance with discrepancy information regarding a deviation of a paper-nozzle distance from a reference value, the paper-nozzle distance representing a distance from the ejection portion of the recording head to the recording medium.

* * * * *

UNITED STATES PATENT AND TRADEMARK OFFICE

CERTIFICATE OF CORRECTION

PATENT NO. : 6,471,315 B1
DATED : October 29, 2002
INVENTOR(S) : Kurata

It is certified that error appears in the above-identified patent and that said Letters Patent is hereby corrected as shown below:

Column 15,
Line 22, “of;” should read -- of: --.

Signed and Sealed this

Twenty-sixth Day of August, 2003

JAMES E. ROGAN
*Director of the United States Patent and Trademark Office*